US006285176B1

(12) United States Patent
Marx et al.

(10) Patent No.: US 6,285,176 B1
(45) Date of Patent: Sep. 4, 2001

(54) VOLTAGE GENERATOR WITH SUPERIMPOSED REFERENCE VOLTAGE AND DEACTIVATION SIGNALS

(75) Inventors: Thilo Marx; Torsten Partsch; Thomas Hein; Patrick Heyne, all of München (DE)

(73) Assignee: Infineon Technologies, Munich (DE)

( * ) Notice: Subject to any disclaimer, the term of this patent is extended or adjusted under 35 U.S.C. 154(b) by 0 days.

(21) Appl. No.: 09/693,778

(22) Filed: Oct. 20, 2000

(30) Foreign Application Priority Data

Oct. 20, 1999 (DE) ..... 199 50 541

(51) Int. Cl.[7] ..... G05F 3/16
(52) U.S. Cl. ..... 323/313
(58) Field of Search ..... 323/313, 314

(56) References Cited

U.S. PATENT DOCUMENTS

| | | | | |
|---|---|---|---|---|
| 5,189,316 | * | 2/1993 | Murakami et al. | 323/314 |
| 5,434,498 | * | 7/1995 | Cordoba et al. | 323/313 |
| 5,479,093 | * | 12/1995 | Jeon | 323/313 |
| 5,483,152 | * | 1/1996 | Hardee et al. | 323/314 |
| 5,552,740 | | 9/1996 | Casper | 327/541 |
| 5,557,232 | | 9/1996 | Shimogawa | 327/545 |
| 5,570,005 | * | 10/1996 | Hardee et al. | 323/314 |
| 5,592,121 | * | 1/1997 | Jung et al. | 323/314 |
| 5,831,421 | * | 11/1998 | Taira et al. | 323/314 |
| 5,994,950 | | 11/1999 | Ochi | 327/543 |
| 6,114,843 | * | 9/2000 | Olah | 323/314 |

FOREIGN PATENT DOCUMENTS

| | | | |
|---|---|---|---|
| 0 454 170 A2 | 10/1991 | (EP) | G05F/1/46 |
| 0 843 247 A2 | 5/1998 | (EP) | G05F/1/46 |
| 60-124 715 | 7/1985 | (JP) | G05F/1/10 |
| 10 150 152 | 6/1998 | (JP) | G05F/1/56 |

* cited by examiner

*Primary Examiner*—Jeffrey Sterrett
(74) *Attorney, Agent, or Firm*—Herbert L. Lerner; Laurence A. Greenberg; Werner H. Stemer

(57) ABSTRACT

A voltage generator configuration includes a voltage generator which generates a second voltage from a first voltage using a reference voltage and which can be deactivated by using a deactivation signal. The voltage generator configuration is distinguished in that the deactivation signal is fed to the voltage generator over a line through which the reference voltage is also fed to the voltage generator.

7 Claims, 2 Drawing Sheets

VOLTAGE GENERATOR WITH SUPERIMPOSED REFERENCE VOLTAGE AND DEACTIVATION SIGNALS

BACKGROUND OF THE INVENTION

Field of the Invention

The present invention relates to a voltage generator configuration including a voltage generator which generates a second voltage from a first voltage using a reference voltage and which can be deactivated by using a deactivation signal.

Such voltage generators are used in integrated circuits to generate a regulated internal voltage from an unregulated external voltage, for example. A regulated internal voltage may be needed so that the signal transit times are independent of the external voltage. Such an internal voltage is advantageously generated by using a temperature-dependent and process-dependent reference voltage.

For example, it may be necessary for testing purposes to deactivate the voltage generator and/or to switch it into a state of high resistance.

A voltage generator which generates a second (internal) voltage from a first (external) voltage using a reference voltage and which can be deactivated by using a deactivation signal, is represented in FIG. 2 and described in detail below.

A configuration in which a plurality of voltage generators are connected in a parallel manner and distributed more or less uniformly over the integrated circuit, is represented in FIG. 3 and described in detail below. It can be easily seen from FIG. 3 that the practical realization of such a configuration is associated with a substantial outlay. In addition, it is particularly problematic that several long lines (extending over the entire integrated circuit) must be provided.

SUMMARY OF THE INVENTION

It is accordingly an object of the invention to provide a voltage generator configuration, which overcomes the hereinafore-mentioned disadvantages of the heretofore-known devices of this general type in such a way that one or more voltage generators of this type can be integrated into integrated circuits with minimal outlay.

With the foregoing and other objects in view there is provided, in accordance with the invention, a voltage generator configuration, comprising a voltage generator generating a second voltage from a first voltage using a reference voltage, the voltage generator being deactivated by using a deactivation signal; and a line feeding the reference voltage and the deactivation signal to the voltage generator.

In this way, it is possible to reduce the number of lines that must be provided for feeding to the voltage generator the voltages and signals that are required for the operation and control thereof.

No adverse effects result from feeding the reference voltage and the deactivation signal to the voltage generator through one and the same line, since simultaneous (superimposed) transmission is not required.

Voltage generators which are constructed as claimed can therefore be integrated into integrated circuits with minimal outlay.

In accordance with another feature of the invention, the voltage generator is switched into a high-resistance state by the deactivation signal.

In accordance with a further feature of the invention, the deactivation signal interrupts feeding of a supply voltage needed by the voltage generator to the voltage generator.

In accordance with an added feature of the invention, the line feeding the reference voltage to the voltage generator is charged with the deactivation signal to deactivate the voltage generator.

In accordance with an additional feature of the invention, the line is set to a potential differing from the reference voltage, for charging the line with the deactivation signal.

In accordance with yet another feature of the invention, there is provided a reference voltage generator generating the reference voltage, the reference voltage generator being deactivated to deactivate the voltage generator.

In accordance with a concomitant feature of the invention, there is provided a reference voltage generator generating the reference voltage, the reference voltage generator being switched into a state in which it emits the deactivation signal to deactivate the voltage generator.

Other features which are considered as characteristic for the invention are set forth in the appended claims.

Although the invention is illustrated and described herein as embodied in a voltage generator configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
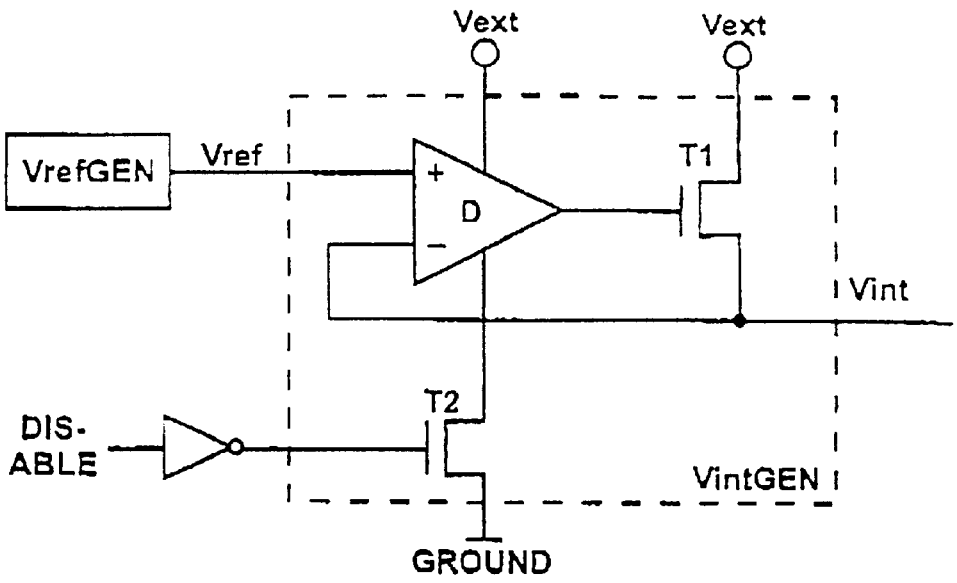
FIG 2 Prior Art
FIG. 2 is a schematic and block circuit diagram of a conventional voltage generator which generates a second voltage from a first voltage using a reference voltage and which can be deactivated by using a deactivation signal.

Referring now to the figures of the drawings in detail and first, particularly, to FIG. 2 thereof, there is seen a voltage generator which generates a second (internal) voltage from a first (external) voltage by using a reference voltage and which can be deactivated by using a deactivation signal.

In FIG. 2, the voltage generator is indicated by reference symbol VintGEN, the first (external) voltage is indicated by reference symbol Vext, the reference voltage is indicated by reference symbol Vref, the second (internal) voltage is indicated by reference symbol Vint, and the deactivation signal is indicated by reference symbol DISABLE. The reference voltage Vref is generated by a reference voltage generator VrefGEN which is provided outside the voltage generator VintGEN. The voltage generator VintGEN contains a difference amplifier D and first and second transistors T1 and T2.

The second (internal) voltage Vint that is generated by the voltage generator VintGEN is a voltage that is switched through by the first transistor T1. This transistor T1 is charged by the first (external) voltage Vext at its input terminal and is controlled by an output voltage of the difference amplifier D. The difference amplifier D compares the reference voltage Vref to the second voltage Vint that is generated by the voltage generator VintGEN, and delivers a signal which corresponds to the difference.

The voltage generator VintGEN can be separated as needed from a supply voltage (which is Vext ground potential GROUND in the given example) that supplies it (the difference amplifier D thereof in the given example) with the aid of the deactivation signal DISABLE. In the given example, the second transistor T2 is controlled by the deactivation signal DISABLE. The transistor T2 is provided in a conduction path through which the difference amplifier D is connected to ground potential GROUND of the supply voltage. A blocking of the transistor T2 by the deactivation signal DISABLE effectuates a separation of the connection to ground and thus a cut-off of the supply voltage feed to the voltage generator.

The voltage Vint that is generated by the voltage generator VintGEN is fed through a Vint-network to components that require this voltage. Voltage losses occur in the distribution of the voltage Vint over the Vint-network. In order to prevent this, it is common to provide a plurality of voltage generators VintGEN in integrated circuits. The plurality of voltage generators are preferably connected in a parallel manner and distributed more or less uniformly over the integrated circuit. This kind of configuration of a 99 P 5062 plurality of voltage generators VintGEN1, VintGEN2, VintGEN3 and VintGEN4 is schematically represented in FIG. 3.

Figure 3:
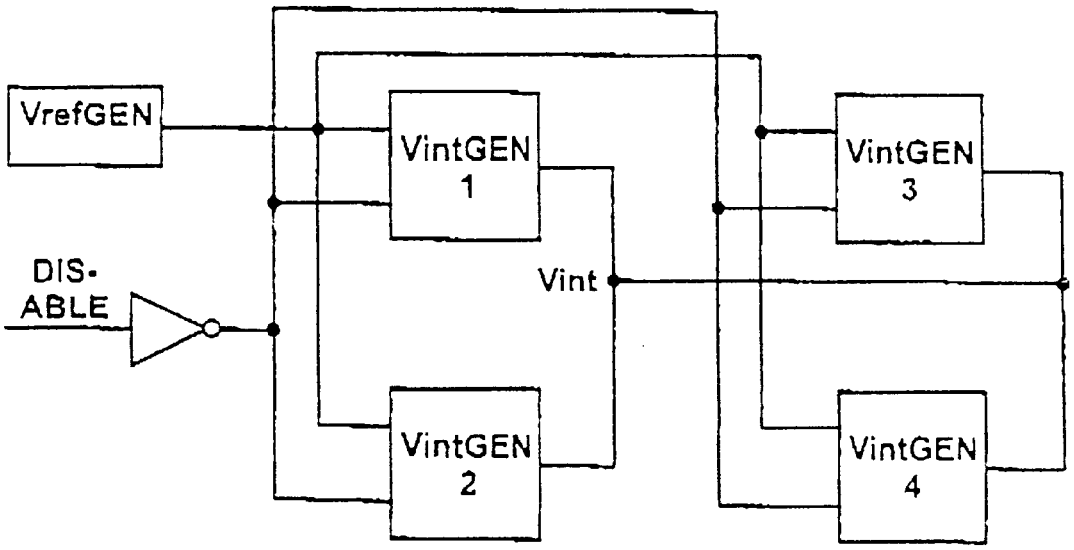
FIG 3 Prior Art
FIG. 3 is a schematic and block circuit diagram of a configuration in which several voltage generators as represented in FIG. 2 are connected in a parallel manner.

As can be easily recognized from FIG. 3, the practical realization of such a configuration is associated with a substantial outlay. It is particularly problematic that several long lines (extending over the entire integrated circuit) must be provided.

The voltage generator that will now be described is a voltage generator which generates a second voltage from a first voltage using a reference voltage and which can be deactivated by using a deactivation signal.

The inner structure of that voltage generator corresponds to the structure of the voltage generator which is represented in FIG. 2 and described above in connection therewith. That is, the voltage generator contains a difference amplifier D and transistors T1 and T2, which are connected as in FIG. 2.

However, it must be noted that this does not constitute a limitation. Both the conversion of the first voltage (the external voltage Vext) into the second voltage (the internal voltage Vint) using a reference voltage and the deactivation of the voltage generator can be accomplished by using other circuits and/or other principles.

Furthermore, the invention is not limited with respect to the first voltage being a voltage that is externally applied to the integrated circuit containing the voltage generator, and/or with respect to the second voltage being a voltage that is required internally (within the relevant integrated circuit). In principle, an arbitrary first voltage can be converted into an arbitrary second voltage.

The present voltage generator is distinguished in that the deactivation signal is fed to the voltage generator through a line through which the reference voltage is also fed to the same.

It is therefore no longer necessary to feed the reference voltage and the deactivation signal to the voltage generator on separate lines.

The effects thereof are particularly advantageous when a plurality of voltage generators must be connected in a parallel manner. That is because the number of lines to the respective voltage generators can be reduced thereby.

Figure 1:
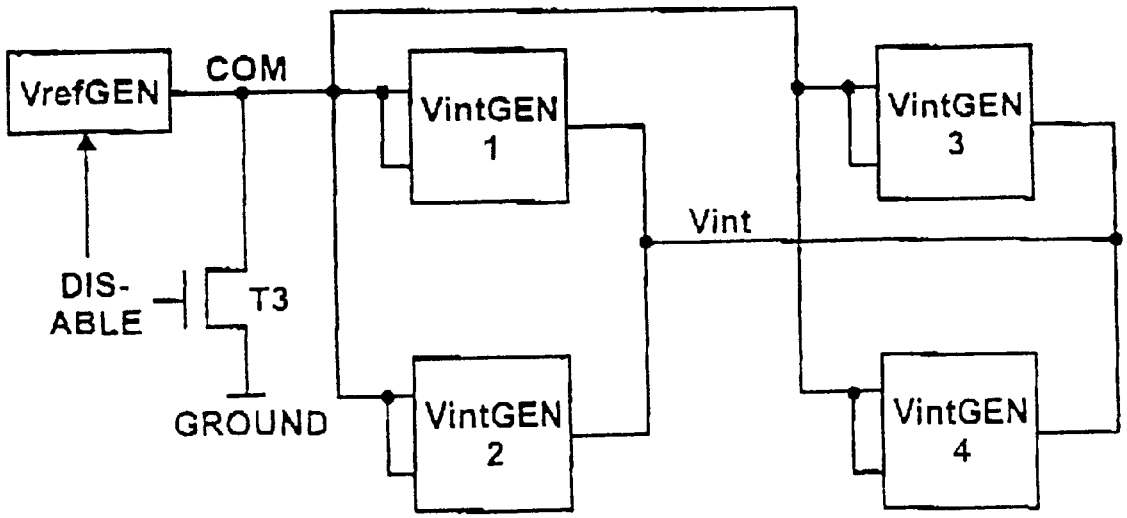
FIG. 1 is a schematic and block circuit diagram of a configuration in which a plurality of voltage generators of the type described below are connected in a parallel manner.

A configuration with several parallel voltage generators of the present type is illustrated in FIG. 1.

The configuration in FIG. 1 corresponds in many points to the configuration in FIG. 3. Elements that correspond to each other are provided with the same reference characters.

As in the configuration in FIG. 3, four voltage generators VntGEN1, VintGEN2, VintGEN3 and VintGEN4 are connected in a parallel manner in the configuration in FIG. 1.

To this extent, this configuration conforms to the configuration in FIG. 3.

However, contrary to the configuration in FIG. 3, the reference voltage Vref and the deactivation signal DISABLE are fed to the voltage generators VintGEN1, VintGEN2, VintGEN3, and VintGEN4 through a common line COM.

This common line COM is charged with the reference voltage Vref that is generated by the reference voltage generator VrefGEN and can be drawn to a potential other than the reference potential (in this example, ground potential) as needed through a transistor T3 that is controlled by the deactivation signal DISABLE.

In the given example, the deactivation signal DISABLE is also used to deactivate the reference voltage generator VrefGEN.

In the present configuration, the voltage generators VintGEN1, VintGEN2, VintGEN3, and VintGEN4 are deactivated by a deactivation signal DISABLE having a high level.

When and as long as the deactivation signal DISABLE has a low level, the reference voltage generator VrefGEN remains in operation, and the transistor T3 blocks. Therefore, the reference voltage Vref that is generated by the reference voltage generator VrefGEN is transmitted through the common reference-voltage/deactivation-signal line COM.

When the deactivation signal DISABLE has a high level, it puts the reference voltage generator VrefGEN out of operation and effectuates a switch-through or enabling of the transistor T3. Therefore, the common reference-voltage/deactivation-signal line COM is drawn to ground potential.

The common reference-voltage/deactivation-signal line COM is connected both to the reference voltage input terminal (the non-inverting input of the difference amplifier D) and to the deactivation signal input terminal (the control terminal of the transistor T2) of the voltage generators VintGEN1, VintGEN2, VintGEN3 and VintGEN4.

When and as long as the reference voltage Vref is being transmitted through the common reference-voltage/deactivation-signal line COM, the external voltage Vext is converted to the internal voltage Vine as specified. The reference voltage that also stands at the transistor T2 effectuates a switch-through of the transistor T2, and the respective voltage generators VintGEN1, VintGEN2, VintGEN3 and VintGEN4 are connected to the supply voltage accordingly.

When the common reference-voltage/deactivation-signal line COM lies at ground potential, the transistor T2 blocks, and the supply voltage of the respective voltage generators VintGEN1, VintGEN2, VintGEN3 and VintGEN4 (the connection of the difference amplifier D to ground) is thereby interrupted. The voltage generators VintGENI, VintGEN2, VintGEN3 and VintGEN4 are deactivated in this state and simultaneously switched into a high-resistance state.

The provision of a common reference-voltage/deactivation-signal line COM allows the voltage generators VintGEN1, VintGEN2, VintGEN3 and VintGEN4 to be operated and deactivated just as if separate lines were provided for the reference voltage and the deactivation signal.

Nevertheless, the number of lines through which the voltage generators VintGEN1, VintGEN2, VintGEN3 and VintGEN4 must be connected to the reference voltage generator VrefGEN and the deactivation signal source is reduced.

Voltage generators of the above-described type can thus be integrated into integrated circuits with minimal outlay, yet without limiting functionality.

We claim:

1. A voltage generator configuration, comprising:

a voltage generator generating a second voltage from a first voltage using a reference voltage, said voltage generator being deactivated by using a deactivation signal; and a line feeding the reference voltage and the deactivation signal to the voltage generator.

2. The voltage generator configuration according to claim 1, wherein said voltage generator is switched into a high-resistance state by the deactivation signal.

3. The voltage generator configuration according to claim 1, wherein the deactivation signal interrupts feeding of a required supply voltage to said voltage generator.

4. The voltage generator configuration according to claim 1, wherein said line feeding the reference voltage to said voltage generator is charged with the deactivation signal to deactivate said voltage generator.

5. The voltage generator configuration according to claim 4, wherein said line is set to a potential differing from the reference voltage, for charging said line with the deactivation signal.

6. The voltage generator configuration according to claim 1, including a reference voltage generator generating the reference voltage, said reference voltage generator being deactivated to deactivate said voltage generator.

7. The voltage generator configuration according to claim 1, including a reference voltage generator generating the reference voltage, said reference voltage generator being switched into a state in which it emits the deactivation signal to deactivate said voltage generator.

* * * * *